United States Patent [19]

Johnson et al.

[11] 4,313,977

[45] Feb. 2, 1982

[54] REDUCED VOLATILITY OF A HALOGENATED PHENOL IN WOOD

[75] Inventors: Robert L. Johnson; Ralph M. Gooch, both of Midland, Mich.

[73] Assignee: The Dow Chemical Company, Midland, Mich.

[21] Appl. No.: 210,952

[22] Filed: Nov. 28, 1980

[51] Int. Cl.[3] ..... B05D 1/18; B05D 3/00; B05D 3/04; B05D 3/10

[52] U.S. Cl. ..... 427/342; 427/297; 427/440

[58] Field of Search ..... 427/297, 298, 325, 342, 427/351, 393, 397, 440, 441

[56] References Cited

U.S. PATENT DOCUMENTS

| | | | |
|---|---|---|---|
| 2,513,429 | 7/1950 | Rosher | 117/138.5 |
| 2,526,892 | 10/1950 | Minich | 260/567.5 |
| 2,957,850 | 10/1960 | Jezl | 260/47 |
| 3,033,746 | 5/1962 | Moyle et al. | 167/31 |
| 3,061,508 | 10/1962 | Morriss, Jr. et al. | 167/42 |
| 3,215,596 | 11/1965 | Moyle et al. | 167/31 |
| 3,393,194 | 7/1968 | Baravalle | 260/247.7 |
| 3,511,691 | 5/1970 | Johnson et al. | 117/72 |
| 3,519,476 | 7/1970 | Bremmer et al. | 427/342 X |

*Primary Examiner*—Michael R. Lusignan

[57] ABSTRACT

The amount of vapor of a halogenated phenol released by wood treated with the halogenated phenol is reduced by contacting the treated wood with an organic compound having cationic groups capable of forming a water-insoluble halogenated phenoxide salt. For example, contacting pentachlorophenol treated wood with a quaternary ammonium such as didecyldimethylammonium chloride significantly reduces the release of pentachlorophenol vapors from the wood.

16 Claims, No Drawings

REDUCED VOLATILITY OF A HALOGENATED PHENOL IN WOOD

BACKGROUND OF THE INVENTION

The present invention relates to a method for reducing the evolution of halogenated phenol vapors from wood.

In the construction of articles from wood, the wood is often treated with a preservative and/or antimicrobial agent to reduce the possibility of microbial deterioration and insect infestation of the wood. Of the various preservatives, including creosote and metal arsenates such as copper-chrome arsenate, pentachlorophenol is widely employed in treating wood due to its ease of application, its effectiveness as a preservative and the retention by the treated wood of its natural characteristics following application. Unfortunately, pentachlorophenol treated wood tends to release pentachlorophenol vapors to the atmosphere.

Heretofore, to reduce the vaporization of pentachlorophenol from the penta treated wood, the wood has been coated with a paint, resin, wax or the like to seal the wood from the atmosphere. (See, for example, U.S. Pat. Nos. 3,511,691 and 3,061,508.) Although the coating initially reduces the release of pentachlorophenol from the wood, its effectiveness is generally dependent on maintaining a sufficient coating integrity, with increasing amounts of pentachlorophenol vapor being released as the film's integrity deteriorates. Moreover, in many cases, the coating destroys the desired natural appearance of the wood.

Therefore, in view of the undesirable features inherent in the prior art for reducing the volatility of pentachlorophenol in wood, it is highly desirable to provide a method for reducing the amounts of pentachlorophenol evolved from wood treated therewith without impairing the natural beauty of the wood.

SUMMARY OF THE INVENTION

Accordingly, the present invention is a method for reducing the amount of halogenated phenol vapor released by wood treated with a halogenated phenol. Said method comprises the step of contacting the halogenated phenol treated wood with an organic compound containing cationic groups capable of forming a water-insoluble organic salt of the halogenated phenol in situ. The organic, salt-forming compound is of a type and employed in an amount sufficient to reduce the halogenated phenol vapor released by the treated wood.

Surprisingly, upon contacting the halogenated phenol treated wood with a suitable cationic compound, an organic salt of the phenol is formed in situ which results in significantly reducing the amount of halogenated phenol released by the wood. Moreover, the resulting combination of wood and the halogenated phenoxide exhibits unexpected resistance to microbial attack.

In a preferred embodiment, the present invention is employed in a method for processing the wood in a house constructed of wood treated with pentachlorophenol. In said embodiment, the pentachlorophenol treated wood is subsequently contacted with an organic compound containing cationic groups capable of forming a salt with pentachlorophenol in situ. By applying a sufficient amount of the organic, salt-forming compound, the release of pentachlorophenol vapors from the wood is effectively reduced without affecting the ability of the wood to resist microbial attack.

The wood containing the halogenated phenoxide is useful for a wide variety of applications including treating wood employed in building houses such as in the construction of the so-called "log homes" and all-weather wood foundations; treating fence posts, construction lumber and the like.

DETAILED DESCRIPTION OF THE INVENTION

As used herein, the term "halogenated phenol" refers to an aromatic compound in which one or more hydroxy groups and one or more halo groups are bonded directly to the aromatic ring and to the water-soluble salts, particularly the alkali metal salts, thereof. In general, the halogenated phenol advantageously has a single hydroxy group and at least 3 halo groups bonded directly to the aromatic ring. Preferred halogenated phenols are represented by the generalized structural formula:

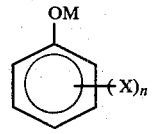

wherein each X is independently bromine or chlorine, preferably chlorine, M is hydrogen or an alkali metal, preferably hydrogen, and n is an integer from 3 to 5, preferably 4 or 5. Representative halogenated phenols include pentachlorophenol; 2,3,4,6-tetrachlorophenol; 2-bromo-4,6-chlorophenol; 2,4,5,6-tetrachlorophenol; 2,4,5-trichlorophenol; 2,6-dibromo-4-chlorophenol, 2,4,6-trichlorophenol; 2,4,6-tribromophenol; mixtures thereof; and the like. Most preferred of the halogenated phenols is pentachlorophenol, which is often conventionally employed as a wood preservative, and mixtures of pentachlorophenol with other halogenated phenols.

The halogenated phenol is advantageously employed in amounts sufficient to impart the desired antimicrobial properties to the wood. In general, the amounts of the halogenated phenol most advantageously employed will vary depending on a variety of factors including the type of wood to be protected, the specific halogenated phenol employed and the desired properties of the treated wood. Typically, the wood is treated with an amount of halogenated phenol varying from about 0.05 to about 5 weight percent based on the weight of the wood. In general, the wood is more advantageously treated with from about 0.1 to about 3, preferably from about 0.2 to about 2.0, weight percent of the halogenated phenol based on the weight of the wood. Although such amounts of halogenated phenol may be uniformly distributed throughout the treated wood, the concentration of the halogenated phenol generally varies throughout the wood, with higher concentrations being on the surface of the treated wood.

In the practice of this invention, the volatility of the halogenated phenol in the wood is reduced using an organic compound capable of forming a salt of the halogenated phenol in situ, i.e., forms a halogenated phenoxide salt in wood which has previously been treated with a halogenated phenol, which phenoxide salt exhibits a lower vapor pressure than the halogenated phenol originally contained by the wood. Representative of such organic, salt-forming compounds are the secondary and tertiary amines having at least one alkyl substituent group of at least about 8 carbon atoms and those organic compounds, such as the quaternary ammoniums, having a pH independent cationic group, i.e., an onium ion, capable of displacing the hydrogen, alkali metal or other group bonded to the oxygen atom bonded directly to the aromatic ring of the halogenated phenol contained by the wood, thereby converting the phenol to an onium salt having a lower volatility than the original phenolic compound. Preferably, the organic, salt-forming compound is water-soluble. As used herein, the term "pH independent cationic group" or "onium ion" refers to a cationic group which is essentially completely ionized in water over a wide range of pH, e.g., pH values from about 2 to about 12, and the term "onium compound" refers to compounds having such groups. Representative of such onium compounds are the quaternary ammoniums (i.e., $(R)_4N^{\oplus}Y^{\ominus}$), the quaternary phosphoniums (i.e., $(R)_4P^{\oplus}Y^{\ominus}$); tertiary sulfonium (i.e., $(R)_3S^{\oplus}Y^{\ominus}$); quaternary antimonium (i.e., $(R)_4Sb^{\oplus}Y^{\ominus}$) and the like wherein each R is independently a hydrocarbyl or an inertly substituted hydrocarbyl and $Y^{\ominus}$ is an anion. By the term "inertly substituted hydrocarbyl" is meant a hydrocarbyl bearing a substituent group or a group in the hydrocarbyl chain which group is essentially inert during the practice of the present invention. Advantageously, at least one R group of any onium compound is an alkyl or aralkyl group, preferably an alkyl group having at least about 6 carbon atoms, more preferably from about 10 to about 20 carbon atoms. Although the remaining R groups of any onium compound can be aliphatic, aromatic or a combination thereof, they are advantageously aliphatic groups, more advantageously alkyl groups having from 1 to about 20, preferably from 1 to about 12, carbon atoms. The anion ($Y^{\ominus}$) is generally an anion of a material (i.e., atomic or molecular free radical) having a higher electronegativity than the halogenated phenoxyl radical (i.e.,

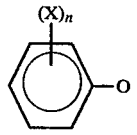

and Y is advantageously $OH^{\ominus}$,

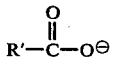

wherein R' is an alkyl group, advantageously methyl or ethyl or $X^{\ominus}$ where X is a halogen. Preferably, the anion is a halogen ion, with an ion of chlorine or bromine being more preferred.

Preferred onium compounds are the quaternary ammoniums, with the preferred quaternary ammoniums being represented by the structural formula:

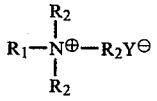

wherein $R_1$ is an alkyl or aralkyl group; each $R_2$ is independently an alkyl group or aralkyl group and $Y^{\ominus}$ is as hereinbefore described. Representative examples of such quaternary ammonium compounds include tetramethylammonium chloride, dodecyltrimethylammonium chloride, dodecyltrimethylammonium bromide, dodecyltrimethylammonium hydroxide, dodecyltrimethylammonium acetate, cetyltrimethylammonium chloride, cetylethyldimethylammonium chloride, didecyldimethylammonium chloride, dioctyldimethylammonium chloride, and the like. Advantageously, $R_1$ is a long chain alkyl group having at least about 8 carbon atoms, more preferably 10 carbon atoms, most preferably from about 10 to about 18 carbon atoms; each $R_2$ is an alkyl group having from 1 to about 20, preferably 1 to 12, carbon atoms, with $R_2$ being more preferably methyl or ethyl, and $Y^{\ominus}$ is $Cl^{\ominus}$, $Br^{\ominus}$,

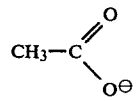

or $OH^{\ominus}$, more preferably $Cl^{\ominus}$ or $Br^{\ominus}$. Most preferred quaternary ammoniums are dodecyltrimethylammonium chloride, cetyltrimethylammonium chloride, tetradecyltrimethylammonium chloride, cetyldimethylethylammonium chloride, cetyldimethylbenzylammonium chloride and didecyldimethylammonium chloride.

The organic, salt-forming compound is employed in amounts sufficient to reduce the amount of the halogenated phenol vapor released by the halogenated phenol treated wood. For the purposes of this invention, such reduction is evidenced when the wood treated with the halogenated phenol and subsequently contacted with the salt-forming compound releases measurably less halogenated phenol vapor than wood treated with identical amounts of the halogenated phenol. The amounts of the halogenated phenol vapor released by the wood are measured using conventional techniques such as described in Example 1. In general, the salt-forming compound is employed in amounts sufficient to reduce the amount of the halogenated phenol vapor released by the wood by at least about 60, advantageously at least about 90, more advantageously at least about 95, most advantageously at least about 99, percent of the vapor released by the wood. In general, when reduced by such amounts, the halogenated phenol vapor released by the wood is less than about 0.12, preferably less than 0.02, more preferably less than about 0.007 mg of halogenated phenol per cubic meter of air when tested by the method described by Note 2 of Table I.

In general, the most advantageous amounts of the organic, salt-forming compound employed will vary depending on the type and amount of halogenated phenol, the specific wood type treated and the onium compound employed. Typically, in contacting wood which has previously been treated with the halogenated phenol, from about 0.3 to about 2 equivalents of the salt forming compound are advantageously applied to the wood per equivalent of halogenated phenol contained in the wood to obtain such reductions in the amount of halogenated phenol vapor released by wood. Advantageously, the salt forming compound is employed in amounts sufficient to convert essentially all the halogenated phenol to salt form. Therefore, the salt-forming compound is preferably employed in amounts from about 0.8 to about 1.8, more preferably from about 1 to about 1.5, equivalents per equivalent of the halogenated phenol. In general, the hereinbefore specified amounts of salt forming compound employed will also reduce the leaching of the halogenated phenol from the wood.

Such amounts of salt forming compound are easily applied to the treated wood by forming an aqueous solution of the salt forming compound and thereafter contacting the treated wood with the resulting aqueous solution using conventional techniques such as brushing, spraying, conventional pressure treatment or by submerging the wood in an aqueous solution. The concentration of the salt forming compound in the aqueous solution is not narrowly critical to the practice of this invention provided the aqueous solution has a sufficient concentration of the salt forming compound such that the desired amounts of halogenated phenol are converted to salt form at the conditions of application employed. In general, using conventional spraying or brushing techniques, aqueous solutions composed of from about 1 to about 20, preferably from about 3 to about 10, weight percent of the salt forming compound based on the total weight of the solution have been found to be advantageously employed herein.

To improve the penetration of the salt-forming compound into the wood, the aqueous solution of the organic, salt-forming compound optionally, but advantageously, contains minor amounts of a water-miscible organic liquid such as aliphatic alcohols, preferably an alkyl alcohol, e.g., ethanol or isopropanol; glycols and glycol ethers such as propylene glycol methyl ether. In general, when employed, such organic liquids are employed in amounts from about 5 to about 20 weight percent based on the weight of the aqueous solution of the salt-forming compound. In addition, said aqueous solution optionally can contain a nonionic surfactant such as isooctylphenyl polyethoxy ethanol. When employed, said nonionic surfactant is advantageously employed in an amount from about 0.05 to about 2, more advantageously from about 0.1 to about 1, weight percent based on the weight of the aqueous solution.

In addition, a water-soluble, polyvalent metal salt, particularly a polyvalent metal salt of a carboxylic acid, i.e., metal acetate, is often advantageously included within the aqueous solution of the organic, salt-forming compound. Representative of such polyvalent metal salts are the alkaline earth metal acetates such as magnesium acetate and calcium acetate; Group IB and Group IIB metal acetates such as copper acetate or zinc acetate and Group IIIA and Group IVA metal acetates such as aluminum acetate or lead acetate. Preferred of such polyvalent metal salts are those which do not alter the natural coloring of the wood after application, with zinc acetate, aluminum acetate and magnesium acetate, particularly magnesium acetate, being more preferred. Such metal salts are employed to replace the organic, salt-forming compound. In general, the polyvalent metal salts are used in amounts such that the aqueous solution comprises at least 25, more preferably at least about 40, weight percent of the organic, salt-forming compound based on the weight of the polyvalent metal salt and the organic, salt-forming compound.

The following examples are set forth to illustrate the embodiments of the present invention and should not be construed to limit its scope. In the examples, all parts and percentages are by weight unless otherwise indicated.

EXAMPLE 1

Two end grain spruce blocks (3.5 cm×5 cm×0.5 cm) having been treated with a methylene chloride solution of pentachlorophenol at conditions such that the wood contains about 0.5 weight percent pentachlorophenol uniformly dispersed therethrough is immersed in an aqueous solution of 0.634 weight percent didecyldimethylammonium chloride at conditions such that the wood absorbs about 1.8 equivalents of the quaternary ammonium for each equivalent of pentachlorophenol contained by the wood (the immersion is conducted for a period of 60 minutes at ambient temperatures, e.g., about 18° to about 25° C.). The resulting wood sample contains the didecyldimethylammonium salt of pentachlorophenol and is designated Sample No. 1 for the purposes of this invention.

In a similar manner, pentachlorophenol treated end grain spruce blocks (two each) are contacted with the various quaternary ammonium salts specified in Table I to form wood comprising the corresponding quaternary ammonium salt of pentachlorophenol (Sample Nos. 2–5). For purposes of comparison, a pentachlorophenol treated end grain spruce sample is not subsequently processed (Sample No. C).

One end grain spruce block from each sample is tested to determine the amount of pentachlorophenol vapors released by the wood block. The other block from each sample is tested for resistance to microbial attack. The results of this testing are recorded in Table I.

TABLE I

| Sample No. | Salt Forming Compound (1) Type | Salt Forming Compound (1) Amount, Eq/Eq | Penta Vapor (2) Amt, mg/m | Penta Vapor (2) % Red. | Microbial Resistance (3) |
|---|---|---|---|---|---|
| C* | — | — | 0.615 | — | Excellent |
| 1 | DDDMACl | 1.8 | 0.0047 | 99 | Excellent |
| 2 | ADMBACl | 1.8 | 0.0107 | 98 | Excellent |
| 3 | TMACl | 1.8 | 0.0463 | 92 | Good |
| 4 | CTMACl | 1.8 | 0.0046 | 99 | Excellent |

TABLE I-continued

| Sample No. | Salt Forming Compound (1) Type | Amount, Eq/Eq | Penta Vapor (2) Amt, mg/m | % Red. | Microbial Resistance (3) |
|---|---|---|---|---|---|
| 5 | NHTMACl | 1.8 | 0.037 | 94 | Good |

*Not an example of this invention.
(1) The type of onium compound is set forth in abbreviated form wherein:
DDDMACl = didecyldimethylammonium chloride
ADMBACl = alkyl ($C_{12}$, $C_{14}$, $C_{16}$) dimethylbenzylammonium chloride
TMACl = tetramethylammonium chloride
CTMACl = cetyltrimethylammonium chloride
NHTMACl = N-(3-chloro-2-hydroxypropyl)trimethylammonium chloride.
The amount of the organic, salt-forming compound is given in equivalents of the salt forming compound in the wood per equivalent of pentachlorophenol in the originally treated wood.
(2) The amount of pentachlorophenol vapor released by each wood block is determined by exposing the block to a constant flow of purified air and capturing the pentachlorophenol and other halogenated phenols (e.g., tetrachlorophenol) released by the wood to the purified air on silica gel. In said determination, the wood block is cut into two approximately equal size pieces which are placed in a cylindrical glass tube having an inside diameter of 2.5 cm and a length of 25.5 cm. The tube is capped at both ends with silica gel. Air, at a constant flow rate of 8.2 l/hr, is passed through the inlet end of the tube and purified by the silica gel. As the air passes out the tube, the silica gel in the exit end of the tube absorbs the pentachlorophenol released by the wood and now contained in the exit air. The amount of pentachlorophenol in this silica gel is then determined using conventional gas-liquid chromatography techniques.
The percent reduction in pentachlorophenol vapor relesed by the wood is found using the formula $$\frac{V_t - V_c}{V_t} \times 100$$

wherein $V_t$ is the amount of vapor released by the pentachlorophenol treated wood, as measured in milligrams (mg) of pentachlorophenol per cubic meter ($m^3$) of air, and $V_c$ is the amount of vapor released by the wood following subsequent contact with the onium compound.
(3) Resistance to microbial attack is determined in the following manner. A surface of a sterile malt yeast agar plate is seeded with *Lenzites trabea* spores. The culture is allowed to grow for a one-week period at 30° C. At this time, wood which is steam treated to about a 25 weight percent moisture content (i.e., that moisture content required for growth of the microbe) is placed on the agar plate. The further growth of the fungus is examined periodically. The subjective rating of poor indicates that the significant microbial (fungal) attack has occurred through much of the wood within a one-week period; a rating of good indicates the microbial attack is limited to the surfaces of the wood after a two-week period and a rating of excellent indicates substantially no microbial attack in a two-week period. An untreated wood block is tested by this method and found to exhibit poor resistance to microbial attack.

As evidenced by the data set forth in Table I, the pentachlorophenol vapors released by pentachlorophenol treated wood subsequently contacted with an organic, salt-forming compound is substantially less than the pentachlorophenol vapor released by pentachlorophenol treated wood wherein the pentachlorophenol has not subsequently been converted to a water-insoluble salt. As noted in Table I, more than a 99 percent reduction in the amount of pentachlorophenol vapor released can be obtained, with quaternary ammonium compounds containing longer chain alkyl groups generally being more effective in reducing the release of pentachlorophenol vapors. In addition, the wood containing the phenoxide salts exhibited an equivalent resistance to microbial attack.

Similar reduction in the amount of pentachlorophenol vapors released by the wood and resistance to microbial attack are obtained when end grain spruce blocks treated with a mineral spirits solution of pentachlorophenol are subsequently contacted with identical amounts of the organic, salt-forming compound except the pentachlorophenol wood contacted with tetramethylammonium chloride showed only about 66 percent reduction in released pentachlorophenol vapors.

When contacted with bis(2-hydroxyethyl)dimethylammonium chloride and N-cetyl-N-ethyl-morpholinium ethosulfate by the method of this Example, the amount of pentachlorophenol vapors released by a pentachlorophenol treated block are reduced by about 43 and 89 percent, respectively.

EXAMPLE 2

Following the procedure of Example 1, pentachlorophenol treated blocks (two each) of end grain spruce are subsequently contacted with the various amounts of didecyldimethylammonium chloride specified in Table II (Sample Nos. 1–4). As a control, pentachlorophenol treated wood blocks (Sample No. C) are not subsequently processed.

One block from each sample is tested to determine the amount of pentachlorophenol vapor released by the block. The other block from each sample is tested for resistance to microbial attack. The results of this testing are recorded in Table II.

TABLE II

| Sample No. | Salt Forming Compound (1) Type | Amount, Eq/Eq | Penta Vapor (2) Amt, mg/m | % Red | Microbial Resistance (3) |
|---|---|---|---|---|---|
| C* | — | — | 0.291 | — | Excellent |
| 1 | ADMBACl | 0.25 | 0.027 | 94.1 | Good |
| 2 | ADMBACl | 0.5 | 0.0206 | 95.5 | Good |
| 3 | ADMBACl | 1.0 | 0.0213 | 95.4 | Excellent |
| 4 | ADMBACl | 1.5 | 0.0083 | 98.2 | Excellent |

*Not an example of this invention.
(1) Same as (1) in Table I.
(2) Same as (2) in Table I.
(3) Same as (3) in Table I.

As evidenced by the data recorded in Table II, the halogenated phenol vapor released by the wood is somewhat dependent on the amount of salt forming compound employed, with lesser amounts of halogenated phenol generally being released with increasing amounts of the salt forming compound employed.

EXAMPLE 3

An aqueous solution containing about 10 percent of didecyldimethylammonium chloride is brushed on a pentachlorophenol treated stake (1.9 cm×1.9 cm×23 cm) of southern yellow pine. After allowing the stake to dry for about 5 hours, a second coat of the aqueous solution is again brushed on the stake (Sample No. 1). In a similar manner, two coats of an aqueous solution of 10 percent alkyl ($C_{12}$, $C_{14}$, $C_{16}$) dimethylbenzylammonium chloride are applied to a stake of southern yellow pine (Sample No. 2). For purposes of comparison, a stake previously treated with pentachlorophenol is immersed in a bath of an aqueous solution of about 6.8 percent of didecyldimethylammonium chloride for 15 minutes (Sample No. 3). Similarly, a stake is immersed in a bath of an aqueous solution of about 6.8 percent alkyl ($C_{12}$, $C_{14}$, $C_{16}$) dimethylbenzylammonium chloride (Sample No. 4). As a control, a pentachlorophenol treated southern yellow pine stake is not subsequently processed (Sample No. C). Each stake is tested to determine the amount of pentachlorophenol vapor released thereby. The results of this testing are set forth in Table III.

TABLE III

| Sample No. | Onium Compound (1) Type | Amount, Eq/Eq | Application Method | Penta Vapor (2) Amt, mg/m | % Red. |
|---|---|---|---|---|---|
| C* | — | — | — | 0.489 | — |
| 1 | DDMACl | 2.1 | Brushing | 0.0046 | 99.1 |
| 2 | ADMBACl | 1.3 | Brushing | 0.0110 | 97.8 |
| 3 | DDDMACl | 0.58 | Immersion | 0.069 | 85.9 |

TABLE III-continued

| Sample No. | Onium Compound (1) Type | Amount, Eq/Eq | Application Method | Penta Vapor (2) Amt, mg/m | % Red. |
|---|---|---|---|---|---|
| 4 | ADMBACl | 0.57 | Immersion | 1.25 | 74.4 |

*Not an example of this invention.
(1) Same as (1) in Table I.
(2) Same as (2) in Table I.

As evidenced by the data in Table III, contacting pentachlorophenol treated wood with an onium compound by brushing an aqueous solution thereof on the treated wood or immersing the wood in an aqueous solution of the onium compound reduces the amount of pentachlorophenol vapors released thereby. When brushed with only a single coat of the aqueous solution of the onium compound, the amount of pentachlorophenol vapors released by the wood are significantly reduced but to a lesser degree than wood stakes coated twice.

What is claimed is:

1. A method for reducing the amount of halogenated phenol vapor released by wood treated with the halogenated phenol, said method comprising the step of contacting the halogenated phenol treated wood with an organic compound containing cationic groups capable of forming a water-insoluble organic salt of the halogenated phenol in situ, wherein the organic, salt-forming compound is of the type and employed in an amount sufficient to reduce the halogenated phenol vapor released by the wood.

2. The method of claim 1 wherein the organic, salt-forming compound is an organic compound having a pH independent cationic group capable of converting the halogenated phenol to an onium salt having a lower volatility than the halogenated phenol.

3. The method of claim 2 wherein the organic, salt-forming compound is $(R)_4N^{\oplus}Y^{\ominus}$, $(R)_4P^{\oplus}Y^{\ominus}$, $(R)_3S^{\oplus}Y^{\ominus}$ or $(R)_4Sb^{\oplus}Y^{\ominus}$ wherein each R is independently hydrocarbyl or inertly substituted hydrocarbyl and $Y^{\ominus}$ is an anion.

4. The method of claim 3 wherein at least one R group is an alkyl or aralkyl group.

5. The method of claim 3 wherein at least one R group is an alkyl group having from about 10 to about 20 carbon atoms.

6. The method of claim 3 wherein the organic, salt-forming compound is applied to the halogenated phenol treated wood in an amount varying from about 0.3 to about 2 equivalents of the salt forming compound per equivalent of the halogenated phenol.

7. The method of claim 3 wherein the organic, salt-forming compound is employed in combination with water-soluble, polyvalent metal acetate.

8. The method of claim 3 wherein the halogenated phenol is pentachlorophenol or a mixture thereof with other halogenated phenols.

9. The method of claim 2 wherein the organic, salt-forming compound is a quaternary ammonium represented by the structural formula:

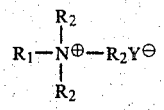

wherein $R_1$ is an alkyl or alkyl group, each $R_2$ is independently an alkyl group and $Y^{\ominus}$ is an anion.

10. The method of claim 9 wherein $R_1$ is a long chain alkyl group having at least 8 carbon atoms, each $R_2$ is independently an alkyl group having from about 1 to about 10 carbon atoms, $Y^{\ominus}$ is $Cl^{\ominus}$, $Br^{\ominus}$,

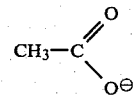

or $OH^{\ominus}$.

11. The method of claim 10 wherein $R_1$ is an alkyl group having from about 10 to about 18 carbon atoms, each $R_2$ is independently methyl or ethyl and $Y^{\ominus}$ is $Cl^{\ominus}$ or $Br^{\ominus}$.

12. The method of claim 11 wherein the halogenated phenol is pentachlorophenol and the organic, salt-forming compound is applied to the pentachlorophenol treated wood in an amount from about 0.8 to about 1.8 equivalents of the salt forming compound per equivalent of halogenated phenol.

13. The method of claim 9 wherein the wood is contacted with an aqueous solution of the organic, salt-forming compound.

14. The method of claim 13 wherein the aqueous solution further comprises a water-miscible, organic liquid; a nonionic surfactant and a water-soluble, polyvalent metal salt.

15. The method of claim 14 wherein the polyvalent metal salt is zinc acetate, aluminum acetate or magnesium acetate and the aqueous solution comprises from about 5 to about 20 weight percent of an alkyl alcohol or a glycol ether and from about 0.5 to about 2 weight percent of a nonionic surfactant wherein said weight percents are based on the weight of the aqueous solution and at least 25 weight percent of the organic, salt-forming compound wherein the weight percent is based on the weight of the organic, salt-forming compound and the polyvalent metal salt.

16. A method for processing the wood in a house constructed of wood treated with pentachlorophenol, said method comprising the step of contacting the pentachlorophenol treated wood with an onium compound containing pH independent, cationic groups capable of forming a salt of the pentachlorophenol, said onium, salt-forming compound being employed in an amount sufficient to reduce the release of pentachlorophenol vapor from the wood without significantly reducing the wood's ability to resist microbiological attack.

* * * * *